US005824191A

United States Patent [19]

Kinsley, Jr.

[11] Patent Number: 5,824,191

[45] **Date of Patent: *Oct. 20, 1998**

[54] PROCESS FOR MAKING A PAPER BASED PRODUCT EMPLOYING A POLYMERIC LATEX BINDER

[75] Inventor: Homan B. Kinsley, Jr., Powhatan, Va.

[73] Assignee: FiberMark Filter & Technical Products, Inc., Richmond, Va.

[ * ] Notice: The term of this patent shall not extend beyond the expiration date of Pat. No. 5,466,366.

[21] Appl. No.: 829,477

[22] Filed: Mar. 28, 1997

Related U.S. Application Data

[63] Continuation of Ser. No. 472,663, Jun. 7, 1995, abandoned, which is a continuation of Ser. No. 103,133, Aug. 9, 1993, Pat. No. 5,466,336.

[51] Int. Cl.[6] ..... D21H 17/10

[52] U.S. Cl. ..... 162/146; 162/158; 162/164.1; 162/164.3; 162/165; 162/168.1; 162/169; 162/179; 162/199; 162/135; 162/206; 162/207

[58] Field of Search ..... 162/164.3, 146, 162/165, 169, 168.1, 158, 135, 179, 199, 206, 207

[56] References Cited

U.S. PATENT DOCUMENTS

| | | | |
|---|---|---|---|
| 3,509,083 | 4/1970 | Winebrenner | 162/169 |
| 4,372,814 | 2/1983 | Johnstone et al. | 162/169 |
| 4,448,075 | 5/1984 | Dailly et al. | 162/168.1 |
| 4,545,854 | 10/1985 | Gomez et al. | 162/164.3 |
| 4,810,329 | 3/1989 | Camisa | 162/168.2 |
| 5,034,097 | 7/1991 | Martinez et al. | 162/164.3 |

*Primary Examiner*—Peter Chin

*Attorney, Agent, or Firm*—Burns, Doane, Swecker & Mathis, L.L.P.

[57] ABSTRACT

The present invention provides a process for making a paper based product which comprises a paper sheet, an aqueous latex binder and a release agent comprised of an emulsion of lecithin and a fatty acid or derivative thereof. In one embodiment, the process comprises first preparing a slurry of a cellulosic pulp and a polymeric latex binder, and then breaking the stability of the latex so that the polymer particles of the latex are able to be deposited on the fibers of the cellulosic pulp. An emulsion comprised of lecithin and a fatty acid or derivative thereof is added during the process. The addition can be to the slurry, or to the web which is formed when the slurry is drained of liquid. The web is then dried to provide the paper based product. In a preferred embodiment, a slurry of cellulosic pulp is first drained of liquid to form a web, with the polymeric latex binder and emulsion being applied to the web prior to drying.

25 Claims, No Drawings

PROCESS FOR MAKING A PAPER BASED PRODUCT EMPLOYING A POLYMERIC LATEX BINDER

This application is a continuation of application Ser. No. 08/472,663, filed Jun. 7, 1995, now abandoned, which in turn is a continuation of application Ser. No. 08/103,133, filed on Aug. 9, 1993. which is now U.S. Pat. No. 5,466,336.

BACKGROUND OF THE INVENTION

The present invention relates to a method for making a paper based product which incorporates a polymeric latex binder. More specifically, the present invention relates to the use of an emulsion in the manufacture of paper based products which have incorporated a polymeric latex binder. The present invention also relates to the manufactured paper products, which products exhibit excellent physical properties, especially tensile strength.

The papermaking industry as well as other industries have long sought methods for enhancing the strength of products formed from fibrous materials such as, for example, paper and board products formed of cellulose fiber or pulp as a constituent. The problems and limitations presented by inadequate dry strength have been particularly acute in the numerous industries where recycled furnish or fiber mechanically derived from wood is utilized in whole or part. In the papermaking industry for example, recycled cellulose fiber is typically used in the manufacture of newsprint and lightweight coated papers. These recycled fibers, however, are of a generally shorter length than chemically-pulped fibers which in turn provides paper having relatively poor dry-strength properties in comparison to paper manufactured from virgin, chemically pulped fiber. The use of virgin chemically pulped fiber for all paper and board production, however, is extremely wasteful in terms of natural resource utilization as well as cost prohibitive in most instances and applications.

Various methods have been suggested in the past for improving the dry-strength and related properties of a sheet formed from fibrous materials such as paper or board materials formed of cellulose fiber. One alternative for improving the dry-strength properties of paper products, for example, involves the surface sizing of the sheet at a size press after its formation. While some of the critical properties of the product may be improved through sizing the surface of the sheet, many papermaking machines, for example, including board and newsprint machines, are not equipped with a size press. Moreover, only the properties of the surface of the sheet are appreciably improved through surface sizing. Surface sizing therefore is either not available to a large segment of the industry or is inadequate for purposes of improving the strength of the product throughout the sheet. The latter factor is especially significant since paper failures during printing, for example, are obviously disruptive to production and extremely costly.

A preferred alternative to surface sizing of a sheet is to increase the strength of the product through the addition of chemical additives directly to the fiber furnish prior to forming the sheet. Common additives at the wet-end of a paper machine, for example, include cationic starch or melamine resins. Among the problems presented by known wet-end additives used in the papermaking industry, however, are their relatively low degree of retention on the cellulose fiber during the initial formation of the sheet at the wet-end of the paper machine. In most applications, significant portions of the wet-end additives accompany the white water fraction as it drains through the wire due to high dilution and the extreme hydrodynamic forces created at the slice of a fourdrinier machine. Alternatively, a significant portion of the additive may be lost in solution during the dwell time between its addition to the stock and the subsequent formation of the sheet on the machine at prevailing operating temperatures. Accordingly, the potential benefits achievable through the use of known methods for internally strengthening fiber products have seldom been realized in practice. Indeed, when the cost of the chemical additives is additionally considered, any marginal benefits actually achieved have been largely disappointing.

The use of various natural and synthetic polymeric materials to improve the strength of the fiber to fiber bond and the water resistance has also been suggested. The use of a polymeric binder, particularly in larger amounts such as 10 weight percent up to 20 weight percent or more, provides a very difficult problem. Even if the polymeric binder is not substantially water soluble and therefore becomes incorporated in the paper web, during drying of the web the polymeric binder can become very sticky and stick to the felts and drying cans employed in commercial operations. As a result, the entire operation must be shut down due to the sticking problem. The potential benefits of using larger percentages of a polymeric binder in a paper based product are therefore lost as such products simply cannot be made from a practical point of view.

The application of various release agents to paper making drier surfaces as well as to heated platens in pressing glue-coated wood particles is well known for preventing the sticking of resin to such surfaces. However, such application of a surface lubricant means the addition of another process step with the consequent increase in production time.

In U.S. Pat. No. 5,034,097, a composition is described which comprises epoxidized polyamide wet-strength resin and lecithin. The addition of lecithin allegedly eliminates the sticking problem encountered on the heated dryers in the manufacture of paper, and particularly in the manufacture of molded pulp products. The lecithin is preferably dispersed in an emulsifying or dispersing agent prior to its incorporation in the epoxidized polyamide. The epoxidized polyamide containing lecithin is then added to the pulp slurry prior to forming the molded product or paper on the wire mesh. Alternatively, each of the epoxidized polyamide and lecithin can be added separately to the aqueous pulp slurry.

Despite the various attempts to overcome the sticking problem, however, the industry is still searching for a solution which can be effectively and most efficiently employed.

Accordingly, an object of the present invention is to provide a process for efficiently making a paper based product by employing a polymeric binder, and more specifically a polymeric latex binder.

Another objective of the present invention is to prepare such a paper based product using commercial papermaking equipment where the product can comprise 10 weight percent up to 20 weight percent and more of the polymeric binder.

Still another object of the present invention is to provide an efficient process for making a paper based product having excellent physical properties, especially tensile strength.

These and other objects of the present invention will become apparent upon a review of the following specification and the claims appended thereto.

SUMMARY OF THE INVENTION

In accordance with the foregoing objectives, the present invention provides a process for making a paper based product which comprises a paper sheet, an aqueous latex binder and a release agent comprised of an emulsion of lecithin and a fatty acid or derivative thereof. In one embodiment, the process comprises first preparing a slurry of a cellulosic pulp and a polymeric latex binder. The colloidal latex polymer particles are then deposited on the surface of the cellulosic fibers. An emulsion comprised of lecithin and a fatty acid or derivative thereof is added to the slurry, before, with or after the latex. Alternatively, the emulsion can be added directly to the formed web after the slurry is drained of liquid to form a web. The web is then dried to provide the paper based product. In another preferred embodiment, a slurry of cellulosic pulp is first drained of liquid to form a web, with the polymeric latex binder and emulsion being applied to the web prior to drying (complete water removal).

The key to the process is the use of an emulsion comprised of lecithin and a fatty acid or derivative thereof, which emulsion permits a web containing a polymeric binder, which would be sticky at the drying temperature employed, to be dried without sticking to the drying cans generally used. The process of the present invention thereby permits one to efficiently prepare such a paper based product employing a polymeric latex binder using conventional, commercial papermaking machinery.

The paper based product prepared by the process of the present invention has also been found to exhibit surprisingly improved strength characteristics. Such characteristics are believed to be the result of the combination of a polymeric latex and the emulsion of lecithin and a fatty acid.

DETAILED DESCRIPTION OF THE PREFERRED EMBODIMENTS

The process of the present invention permits one to efficiently make a paper based product using conventional technology and machinery, despite the fact that the product contains a substantial amount of polymeric binder, added as a latex, to improve the strength of the final product. By employing the process of the present invention, the problem of the binder becoming sticky at the temperature of drying and sticking to the drying cans used in conventional papermaking processes is overcome. The paper based product can therefore be prepared quickly and cost effectively using conventional machinery.

The process of the present invention comprises preparing a slurry of a cellulosic pulp, which can be any pulp, e.g., wood pulp, known for making paper based products. Examples of suitable pulps are northern softwood kraft pulp, southern pine pulp, northern and southern hardwood kraft pulps, and mechanical pulps such as groundwood, CTMP pulp and TMP pulp. Synthetic fibers may also be present in addition to the cellulosic pulp, such synthetic fibers being comprised of any typical synthetic fiber which has been known to be employed in paper based products. Such fibers include nylon, rayon, acrylic, acetate, aramid and polyester fibers. The most preferred synthetic fibers are polyester fibers.

The cellulosic pulp comprises generally from 60 to 90 weight percent of the slurry solids. When synthetic fibers are also present in the slurry, the synthetic fibers can generally comprise from 5 to about 20 weight percent of the slurry solids.

In preparing the paper based product, the slurry of cellulosic pulp is preferably first dewatered on a screen or other suitable, conventional mesh to form the web. Prior to drying the web, an aqueous latex binder together with an emulsion of lecithin and a fatty acid or derivative thereof is applied to the web. The web can then be dried as is conventional to provide the paper based product. This method of first creating the web and then applying the aqueous polymeric latex binder and the lecithin/fatty acid emulsion prior to drying the web is preferred in that it has been found that this method provides a more effective binding as compared to when the latex is added in the wet end, e.g., as part of the beater addition. By applying the polymeric latex binder after the web has been formed, it is believed that the binder localizes more right at the fiber interstices, thereby focusing on the intersecting points of the web. The result is a much stronger web with more uniform bonding by the binder throughout the entire depth of the product.

In an alternative embodiment, the cellulosic pulp can be slurried with the polymeric latex binder and the emulsion of lecithin/fatty acid or derivative thereof. The web can then be formed after the coagulation or precipitation of the latex polymer particles using conventional paper making equipment and subsequently dried. The coagulation of the latex polymer particles can be accomplished by the addition of any suitable chemical which will break the stability of the emulsion or alter the conditions under which the emulsion is stable. For example, alum can be added to cause the latex particles to coagulate and in a sense deposit on the wood cellulose fibers, or the pH can be altered where appropriate to cause such a deposit. It is important to cause such a coagulation and deposit of latex polymer particles, for otherwise the binder would pass through the sheet when the liquid is drained to make the web. The fibers will not be able to filter out the polymeric particles still part of the stable latex. It is only when the dispersion has been broken to allow the polymer particles to coagulate and hence deposit on the fibers that the binder particles will not be lost when the liquid is drained. While this method is satisfactory, using the binder in the slurry, the latex binder will generally coat the fibers so the focus of the binder particles will not be at the interstices, or intersection points, in the resulting web.

A polymeric latex binder which can be used can be any conventional latex binder. Latex binders are generally of an aqueous latex with submicron polymeric particles dispersed in the water. Such latex binders are commercially available. The most preferred include aqueous latexes of polyvinyl chloride, e.g., such as that of ethylene vinyl chloride. Other aqueous latexes which can be used include acrylics, styrene/butadiene rubber latexes, and aqueous latexes of nitrile polymers.

The aqueous emulsion employed is comprised of lecithin and a fatty acid or derivative thereof. The amount of lecithin employed is sufficient to create a stable aqueous emulsion with the fatty acid and/or a derivative (e.g., ester) thereof. In general, the weight ratio of lecithin to fatty acid or derivative thereof in the emulsion ranges from about 1:9 to about 3:7, with about 2:8 being preferred.

The lecithin can be lecithin derived from any plant, animal or microbial source. Suitable lecithin materials are commercially available, and include soybean lecithin and yolk lecithin. The fatty acids are preferably $C_8$–$C_{20}$ fatty acids, or the ester derivative thereof, i.e., the fatty acid ester. More preferably, the fatty acids are those which are of a liquid state at the processing temperature with $C_{12}$–$C_{18}$ fatty acids or derivatives thereof being among the more preferred, and oleic acid being the most preferred due to its availability and excellent results.

It has been found that an emulsion of the lecithin and the fatty acid compound provides an additive which gives excellent release to the web product despite the presence of the sticky polymeric binder, thereby permitting the web to be dried on drying cans and other conventional equipment. An emulsion containing this particular combination of components has also has been found to not significantly reduce the physical properties of tensile and tear strength of the final paper based product. This is an important consideration since many additives can destroy or substantially reduce the physical properties of a paper based web. In fact, the combination of the latex and the emulsion has been found to actually improve the tensile strength. The components of the emulsion are also advantageously ingredients which are safe for use in any materials which are to have contact with food products.

The emulsion comprised of lecithin and fatty acid and/or derivative thereof can be introduced into the slurry at any time in the papermaking process prior to the drying sequence. Therefore, the emulsion can be added to the head box, directly to the pulp (slurry) or anywhere down the line. In an alternative embodiment of the present invention, the emulsion can also be sprayed directly onto the dryer cans, or the web can be sprayed with the emulsion prior to drying. The key is to have the emulsion coat the drying surfaces of the drying cylinders so that when the polymeric binder is tackified by the heat, sticking to the surface of the drying cylinder does not occur. As discussed above, however, it is most preferred that the emulsion be added to the wet cellulosic web together with the polymeric latex binder. It is also convenient when the emulsion is placed directly into the slurry since this permits a most efficient, continuous process without any concerns about the web sticking to the surface of the drying cylinders. If the emulsion were to be sprayed onto the surface of the drying cylinders or on the web prior to entering the drying sequence of the process, such spraying would have to also be continuous or sufficiently periodic to permit the running of a continuous process. An advantage of spraying the emulsion on the formed sheet or drier surface is the elimination of any emulsion in spent water from the paper making process. This will reduce the effluent B.O.D. However, simply creating a slurry containing the emulsion is the most effective and easily accomplished means of conducting the process.

Once the slurry has been prepared, the liquid is drained from the slurry to form a web. A conventional fourdrinier or cylinder machine may be used for this purpose or any suitable dewatering form having apertures can be used. After forming the web by draining the liquid, the web maybe optionally pressed to remove additional water, before drying. It is important that during the drying procedure the web is heated to a temperature where the binder particles become sticky, thus allowing the binder particles to bond with the fibers of the web. When conventional papermaking machinery is used, drying cans are used to dry the continuous paper based product being manufactured.

When the web is formed by draining the liquid from the slurry, provided the latex dispersion has been broken, any polymeric latex binder particles are filtered out by the fibers and becomes part of the paper structure. When the sheet is then heated in the dryer section, the polymeric particulate can cause sticking by melting or dissolving to form an adhesive glue which bonds the fibers together. The presence of the emulsion comprised of lecithin and the fatty acid or derivative thereof, however, has been found to avoid any sticking of the web. The sticking is avoided whether the polymeric binder is present in an amount of about 10 weight percent, 15 weight percent, 20 weight percent or more based on the dry weight of the web. This sticking is avoided by using small amounts of the emulsion, e.g., amounts such that the concentration of organic components (lecithin and fatty acid and/or derivative) in the water used at the headbox or cylinder vat where the web is formed, or in any solution containing the emulsion which is added to an already formed web, ranges from about 500 to about 4000 ppm, and more preferably from about 1000 to about 2500 ppm, and more preferably from 1750–2250 ppm. In any event, the amount of emulsion used can vary and one need use enough simply to avoid the sticking problem of the web to the drying cylinders or cans.

Thus, the process of the present invention with the use of its emulsion permits one to efficiently and effectively prepare a paper based product containing a polymeric latex binder. The resulting product, because of the presence of the combination of latex binder and emulsion has been found to show significantly improved tensile strength characteristics. As a result of such physical properties, the process of the present invention makes it feasible to realize many advantages through the use of such polymeric latex binders.

For example, use of the process of the present invention permits use of polymeric latex binders in preparing paper based products on a continuous basis which have sufficient strength to be useful in forming lube oil filters or any liquid filter media, such as a coolant filter. The preferred polymeric latex to be used in such applications are the latexes involving polymeric ethylene vinyl chloride. The potential for preparing such products is to essentially replace all products which have in the past employed environmentally unfriendly solvent resin systems. One of the major advantages of the present invention is the use of the polymeric latex binder, the basis of which is aqueous. This avoids many of the health and environmental hazards involved when using solvent resin systems.

The present invention will be illustrated in greater detail by the following specific examples. It is understood that these examples are given by way of illustration and are not meant to limit the disclosure or the claims to follow. All percentages in the examples, and elsewhere in the specification, are by weight unless otherwise specified.

EXAMPLE

A lecithin/fatty acid emulsion was prepared by mixing 80% by weight oleic acid with 20% by weight of a lecithin available from Central Soya under the trademark CENTROPHASE HR2B. Sufficient water was added to the mixture to make a 4% by weight aqueous mixture, which was then blended and emulsified. The resulting emulsion was stable.

Several commercially available latex resins were diluted with water and mixed at various levels of the lecithin/fatty acid emulsion. The specific polymeric latexes, identified by their tradename, as well as by the polymer, and the $T_g$ of the latex, are provided in the Table below. The various levels of lecithin/fatty acid emulsion used for the different runs are also identified in the Table below.

Once the latex and lecithin/fatty acid emulsion were mixed, a saturated filter paper was dipped into the bath. The filter based paper was a typical porous paper used for liquid filtration made of 100% cellulosic fibers. The papers were hand pressed onto an aluminum foil and then dried with the aluminum foil against a steam heated dryer surface. A very low surface pressure dryer felt was used to keep the paper/foil in contact with the heated surface. When dry, the degree of difficulty of separating the paper from the foil was determined roughly.

In order to determine the effect of the emulsion on the physical properties of the paper, the tensile, tear and burst strengths of the paper/foil composite were measured. The foil contribution to the physical parameters was low. The tensile of the foil itself was measured to be 6.4 lb/in, whereas the tear strength of the foil was 14 and the burst was 13.

In measuring the physical parameters, the bursting strength was measured in accordance with TAPPI standard T403om-91. The tensile breaking strength was measured in accordance with TAPPI standard T404om-87. The tear strength was measured in accordance with TAPPI standard T414om-82.

The physical properties of the various papers as measured are presented in the Table below. When studied at the 90% confidence level, no loss in tensile strength is observed, even at amounts of 2000 ppm of the aqueous emulsion. In fact, for the tensile strength, several of the runs exhibited an improvement as opposed to the control run having no emulsion. As for the remaining physical properties of tear strength and burst strength, in general, the physical properties remained about the same.

The observed improvements in the tensile strength properties were surprising. At best, one would have expected that the use of the emulsion may not hurt the physical properties. To actually increase the tensile strength provides a significant advantage when using a combination of a polymeric latex with the lecithin/fatty acid emulsion or derivative thereof.

TABLE

| Manuf Co/Grade # Latex Polymer Type/Latex Tg, °C. | PPM of Lecithin and Fatty Acid in Saturating Solution Used | Tensile (lb/in) 90% Confidence Limits | Tear Strength (g) 90% Confidence Limits | Mullen Burst (psi) 90% Confidence Limits |
|---|---|---|---|---|
| Air Prod. and | 0 | 34.9–37.5 | 352–376 | 44–48 |
| Chemicals, Inc. | 500 | 35.4–38.2 | 345–423 | 45–51 |
| 4530 | 1000 | 34.9–37.7 | 355–387 | 44–50 |
| EVC1 | 2000 | 35.7–39.9 | 370–424 | 49–53 |
| 30 | | | | |
| BFGoodrich | 0 | 36.7–40.1 | 375–431 | 57–67 |
| 26450 | 500 | 38.4–40.6 | 380–404 | 53–59 |
| Acrylic | 1000 | 39.4–43.2 | 380–434 | 52–62 |
| 32 | 2000 | 42.0–45.4 | 381–443 | 57–67 |
| BFGoodrich | 0 | 23.9–25.5 | 371–445 | 37–45 |
| 2671 | 500 | 24.0–25.6 | 362–404 | 36–40 |
| Acrylic | 1000 | 23.3–24.5 | 385–437 | 36–40 |
| −11 | 2000 | 24.0–25.4 | 413–412 | 41–45 |
| BFGoodrich | 0 | 41.0–44.0 | 421–435 | 49–57 |
| 26315 | 500 | 40.2–42.0 | 427–459 | 48–56 |
| Acrylic | 1000 | 40.2–43.8 | 414–456 | 53–59 |
| 55 | 2000 | 37.2–41.4 | 416–454 | 49–57 |
| BFGoodrich | 0 | 24.9–28.5 | 345–353 | 43–47 |
| 577 | 500 | 24.9–28.3 | 325–333 | 43–47 |
| Nitril | 1000 | 25.7–27.5 | 300–324 | 38–42 |
| 15 | 2000 | 25.1–26.7 | 288–318 | 36–42 |
| Dow | 0 | 29.6–34.6 | 345–415 | 35–45 |
| DL242 | 500 | 34.5–36.5 | 348–348 | 36–48 |
| SBR | 1000 | 32.7–35.3 | 347–373 | 44–46 |
| 45 | 2000 | 34.9–37.1 | 324–372 | 42–46 |
| BFGoodrich | 0 | 19.0–20.6 | 117–149 | 9–13 |
| 450x60 | 500 | 22.0–24.8 | 117–131 | 13–15 |
| PVC1 (Geon) | 1000 | 22.7–25.3 | 161–193 | 18–22 |
| 37 | 2000 | 22.0–25.0 | 178–220 | 19–23 |

While the invention has been described with preferred embodiments, it is to be understood that variations and modifications may be resorted to as will be apparent to those skilled in the art. Such variations and modifications ar to be considered within the purview and the scope of the claims appended hereto.

What is claimed is:

1. A process for making a paper based product which comprises (i) preparing a slurry comprised of a cellulosic pulp and a polymeric latex binder;

(ii) breaking the stability of the polymeric latex so that the polymer particles are able to be deposited on the fibers of the cellulosic pulp;

(iii) draining the liquid from the slurry to form a web; and (iv) drying the web on dryer cans;

with a release effecting amount of an emulsion comprised of lecithin and a fatty acid or derivative thereof, the amount of lecithin being sufficient to provide a stable emulsion with the fatty acid or derivative thereof, being introduced into the process such that the emulsion coats the surface of the dryer cans to thereby avoid sticking of the web on the dryer cans.

2. The process of claim 1, wherein the slurry is further comprised of synthetic fibers.

3. The process of claim 2, wherein the synthetic fibers comprise nylon, acrylic, rayon, aramid or polyester fibers.

4. The process of claim 2, wherein the synthetic fibers comprise polyester fibers.

5. The process of claim 2, wherein the amount of synthetic fibers comprises from 5 to 20 weight percent of the solids in the slurry.

6. The process of claim 1, wherein the polymeric latex binder is comprised of a polyvinyl chloride latex, acrylic latex, SBR latex or polymeric nitrile latex.

7. The process of claim 6, wherein the binder in the slurry is an ethylene vinyl chloride polymer latex.

8. The process of claim 6, wherein the polymeric binder is present in the slurry in an amount of at least 10 weight percent based upon the solids in the slurry.

9. The process of claim 6, wherein the polymeric binder is present in the slurry in an amount of at least 15 weight percent based upon the solids in the slurry.

10. The process of claim 6, wherein the polymeric binder is present in the slurry in an amount of at least 20 weight percent based upon the weight of solids in the slurry.

11. The process of claim 6, wherein the polymeric binder is present in the slurry in an amount ranging from about 20 to about 30 weight percent based upon the weight of solids in the slurry.

12. The process of claim 1, wherein the weight ratio of lecithin to fatty acid or derivative thereof in the emulsion ranges from about 1:9 to about 3:7.

13. The process of claim 12, wherein the fatty acid or derivative thereof is comprised of a $C_8$ to $C_{20}$ fatty acid or derivative thereof.

14. The process of claim 13, wherein the fatty acid or derivative thereof is comprised of a $C_{12}$ to $C_{18}$ fatty acid or derivative thereof.

15. The process of claim 1, wherein the fatty acid or derivative thereof is comprised of oleic acid.

16. The process of claim 1, wherein the process is run on a fourdrinier machine on which the liquid for the slurry is drained through apertures on a continuously moving mesh and then dried.

17. The process of claim 1, wherein the emulsion is sprayed directly onto the dryer cans.

18. A process for making a paper based product containing a polymeric latex binder which comprises drying the product on dryer cans, and which comprises introducing into the process a release effecting amount of an emulsion comprised of lecithin and a fatty acid or derivative thereof, the amount of lecithin being sufficient to provide a stable emulsion with the fatty acid or derivative thereof, such that the emulsion coats the dryer cans to thereby avoid sticking of the web on the dryer cans upon the polymer particles of the latex binder becoming tacky during the drying process.

19. The process of claim 18, wherein the emulsion is sprayed on the web prior to drying.

20. The process of claim 18, wherein the emulsion is sprayed directly onto the dryer cans.

21. The process of claim 18, wherein the fatty acid contained in the emulsion is comprised of a $C_{12}$–$C_{18}$ fatty acid or derivative thereof.

22. The process of claim 18, wherein the fatty acid contained in the emulsion is comprised of oleic acid.

23. The process of claim 20, wherein the fatty acid contained in the emulsion is comprised of oleic acid.

24. A paper based product containing a polymeric latex binder prepared by the process of impregnating a paper web with a release effecting amount of an emulsion comprising lecithin and a fatty acid or derivative thereof, the amount of lecithin being sufficient to provide a stable emulsion with the fatty acid or derivative thereof and the weight ratio of lecithin/fatty acid being about 1:4, and with the polymeric latex binder being comprised of an aqueous latex of polyvinyl chloride, an acrylic latex, a styrene/butadiene rubber latex, or an aqueous latex of a nitrile polymer.

25. The paper based product of claim 24, wherein the fatty acid contained in the emulsion is comprised of oleic acid.

* * * * *